United States Patent [19]

May et al.

[11] Patent Number: 4,715,602

[45] Date of Patent: Dec. 29, 1987

[54] RACING GAME APPARATUS

[75] Inventors: Richard L. May, Manhattan Beach; Jay Smith, Los Angeles; Harley Wolf, Studio City, all of Calif.

[73] Assignee: Richard L. May & Kennth Curran dba May-Curran Associates, Redondo Beach, Calif.

[21] Appl. No.: 861,356

[22] Filed: May 9, 1986

[51] Int. Cl.[4] ..... A63F 9/14

[52] U.S. Cl. ..... 273/86 R; 446/429; 446/462

[58] Field of Search ..... 273/86 R, 86 B, 86 C, 273/86 D, 86 E, 86 F, 86 G; 446/429, 435, 457, 462, 463

[56] References Cited

U.S. PATENT DOCUMENTS

| | | | |
|---|---|---|---|
| 3,315,632 | 4/1967 | Hyden | 273/86 B X |
| 3,339,923 | 9/1967 | Nadolny | 273/86 B |
| 3,986,717 | 10/1976 | Kirby et al. | 273/86 B |
| 4,541,813 | 9/1985 | Ikeda | 446/429 |
| 4,605,229 | 8/1986 | McKay | 273/86 R |

FOREIGN PATENT DOCUMENTS

| | | | |
|---|---|---|---|
| 2035478 | 1/1972 | Fed. Rep. of Germany | 273/86 B |
| 3016249 | 11/1981 | Fed. Rep. of Germany | 273/86 B |
| 1557404 | 12/1979 | United Kingdom | 446/462 |

*Primary Examiner*—Anton O. Oechsle

*Attorney, Agent, or Firm*—Keith D. Beecher

[57] ABSTRACT

Racing game apparatus in which two or more inertia toy motor vehicles are released from respective ramps and travel along respective tracks to a finish gate. A starting flag assembly is located at the ramp and is released to an upright position when the release mechanism is operated simultaneously by two players. Each ramp is equipped with a trap door and a drop gate which are actuated by a release lever to start the vehicle down the ramp. Prior to the operation of the release lever, each vehicle is started so that its rear wheels are spinning, and each vehicle is placed on the ramp with its rear wheels spinning in the open trap doors and held on the ramps by the respective gates, until the trap doors are closed and the gates released. A gate provided at the finish line which swings open in one direction or the other as struck by the winning car, and which serves to indicate which car won the race.

6 Claims, 12 Drawing Figures

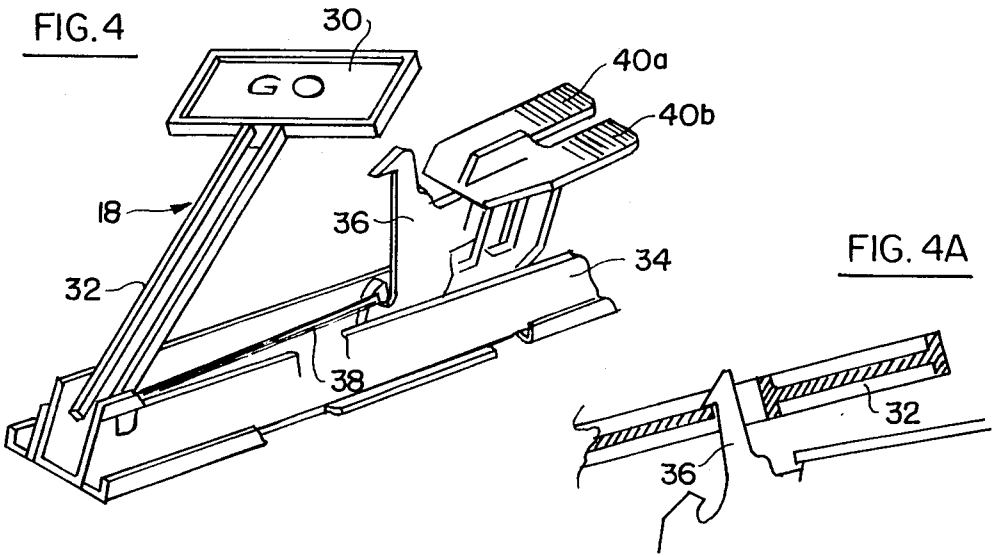
FIG. 4
FIG. 4A
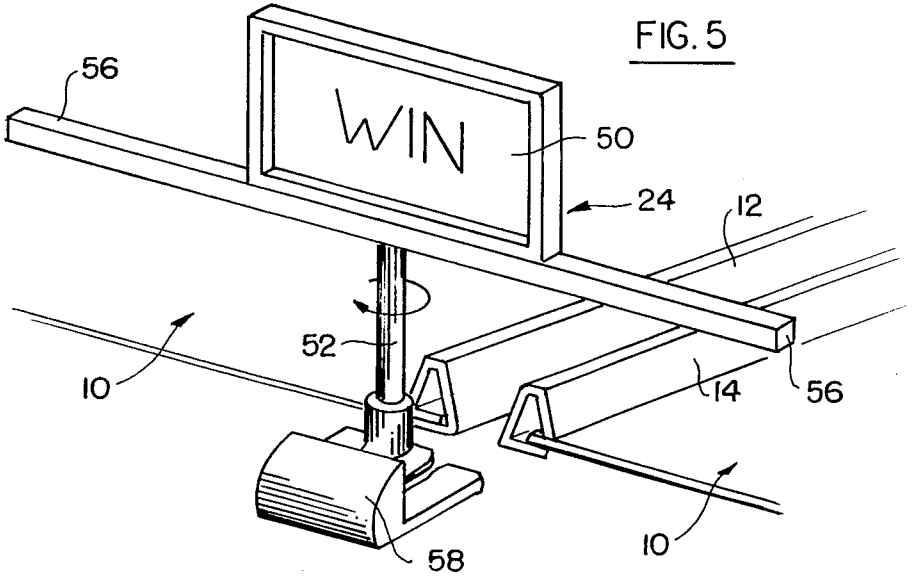
FIG. 5
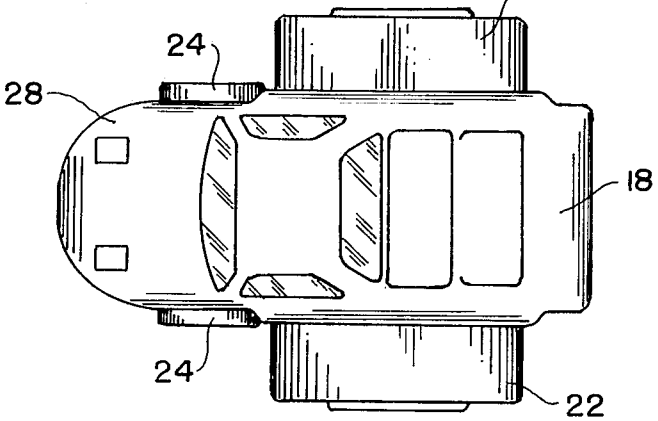
FIG. 2
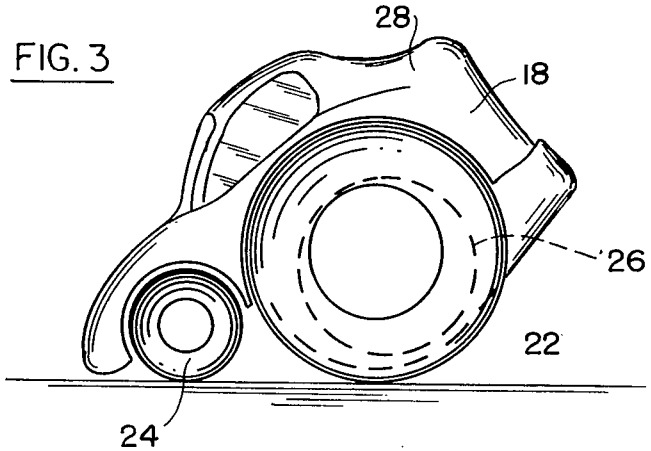
FIG. 3

B-RELEASE CAR

A- CAR HOLDING

RACING GAME APPARATUS

BACKGROUND OF THE INVENTION

There are many types of games on the market which involve racing cars and tracks. An objective of the present invention is to provide such a game which is particularly adapted to use fly wheel type inertia toy cars. The game apparatus is rugged in its construction, is inexpensive to manufacture, does not require any electric or magnetic parts, and is simple to put together and easy and safe to operate.

BRIEF DESCRIPTION OF THE DRAWINGS

FIG. 2 is a top plan view of an appropriate inertia vehicle for use in the game apparatus of the invention;

FIG. 3 is a side view of the vehicle of FIG. 2;

FIG. 4 is a perspective representation of the start flag assembly;

FIG. 4A is a side view, partly in section, of the latch of the start flag assembly;

FIG. 5 is a perspective representation of the winner indicator gate assembly;

DETAILED DESCRIPTION OF THE ILLUSTRATED EMBODIMENT

Figure 1:
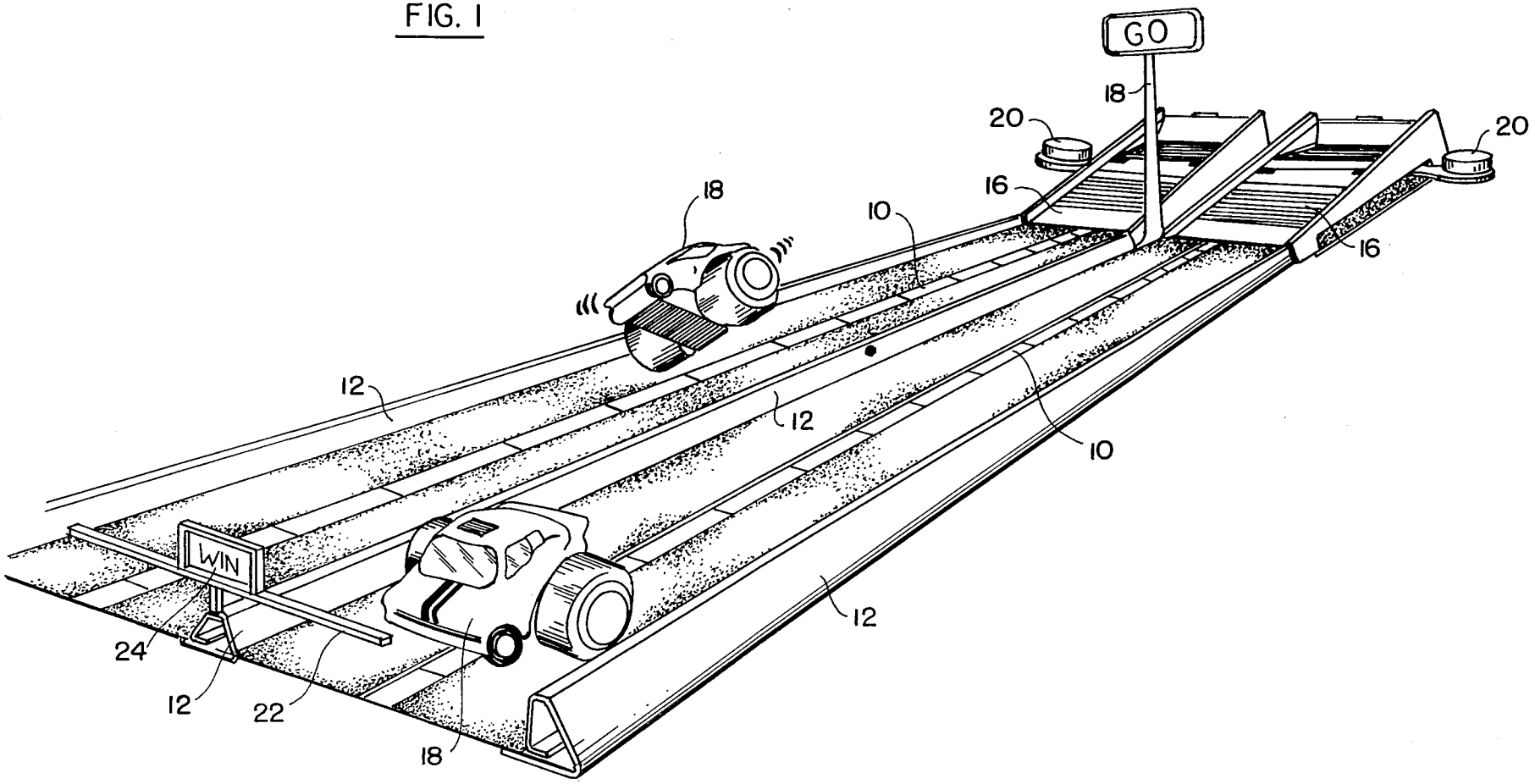
FIG. 1 is a perspective representation of the game apparatus of the present invention including a pair of tracks held adjacent to one another, a ramp at the end of each track, a start gate at the ramps, and a winner indicator gate at the finish end of the tracks.

The game apparatus shown in FIG. 1 includes a pair of tracks, each designated 10, positioned adjacent to one another. Each of the tracks comprises a running surface and each has a pair of side walls 12 and 14 extending along the respective edges thereof. The side walls may be formed, for example, of extruded plastic material.

A ramp 16 is attached to each track, and a starting flag assembly 18 is mounted between the ramps. The starting flag assembly is normally turned to a down position between the tracks. At the start of the race, the starting flag is released so that it will assume its upright position, as shown in FIG. 1. As will be described, each of the ramps 16 has a trap door, and an inertia type vehicle 18 is held on each ramp, until it is released by the operation of a lever 20.

The vehicles 18 then race down the track to the finish end. When one or the other vehicle reaches the finish line it engages an elongated barrier 22 of a win indicator gate 22, and causes the barrier to turn the indicator gate in a particular direction to indicate which car won the race.

The vehicle 18 is shown in FIGS. 2 and 3. The vehicle has a short wheel base, and has a pair of rear wheels 22 of a large diamater as compared with the forward wheels 24. The vehicle also includes a fly-wheel 26 which is mounted low in the vehicle, almost touching the running surface. The motor in the vehicle is an ordinary friction motor which includes a gear train which couples the fly-wheel to the rear wheels. The gear train is designed to include additional gears, as compared with the conventional vehicles of this type, so as to increase the force transmission surface area. The output axle is also increased in diameter as compared with the conventional cars to absorb the greater torque loads of the large rear wheels. In addition, the chassis 28 of the vehicle is designed to be smaller than the body in order to facilitate the mounting of several different designs of bodies on the same chassis. The vehicle 18 may be of the same general type as disclosed in U.S. Pat. Nos. 3,955,429; 4,400,908; and 4,443,967.

The starting flag assembly 18, as shown in FIG. 4, includes a panel 30 which bearing the word "Go" and mounted on the end of an arm 32 which, in turn, is pivoted to a base 34. A latch 36 is also pivotally mounted to the base, and a resilient member such as a rubber band or sping 38 couples the latch to the lower end of the arm 32.

When the arm 32 is moved to its down position, it is engaged by the latch, as shown in FIG. 4A, and the latch holds the flag assembly in its down position. The latch is released by simultaneously depressing both sides 40A and 40B of a release button mechanism. When the release button mechanism is operated, the latch disengages the arm 32, and the panel 30 springs to its up position, indicating that the race may begin.

As will be described, the push buttons 40A and 40B are constructed so that each must be pushed simultaneously by two players before the start flag assembly is released. This prevents any one player from taking advantage of the other.

The base 34 of the starting flag assembly 18 is configured to slide into the sides of each ramp 16, so as to hold the ramp and tracks together in the position shown in FIG. 1.

The win indicator gate assembly 24 is shown in more detail in FIG. 5. The assembly includes a panel 50 which is mounted on a rotatable post 52, and a transverse elongated barrier 56 which extends radially outwardly from the top of the post across the ends of the two tracks 10 of FIG. 1. The base 54 of the win indicator gate extends into the tracks 10 to hold the end of the tracks together in the position shown in FIG. 1.

It is clear that the winning car will strike barrier 56 before the other car causing the win indicator gate to turn either in a clockwise direction or in a counter-clockwise direction, depending on which car won the race, so that the winner may be indicated by the gate.

Figure 8:
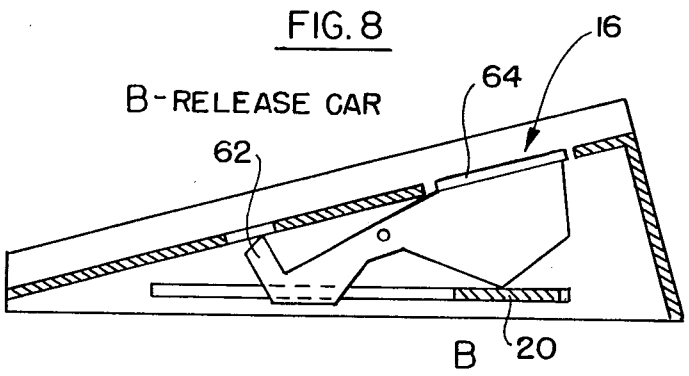
FIG. 8 is a side section of the ramp assembly, like FIG. 6 but showing the trap door in its open position.
Figure 6:
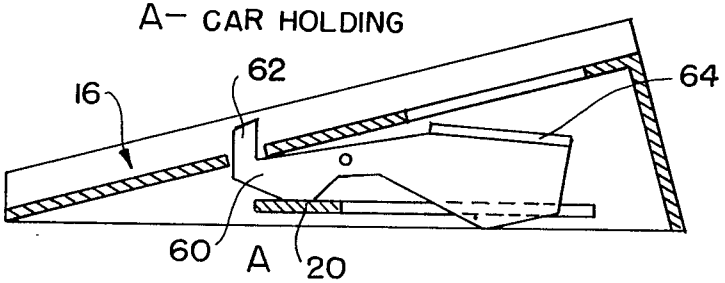
FIG. 6 is a side sectional view of the ramp assembly showing a trap door in a closed position.
Figure 7:
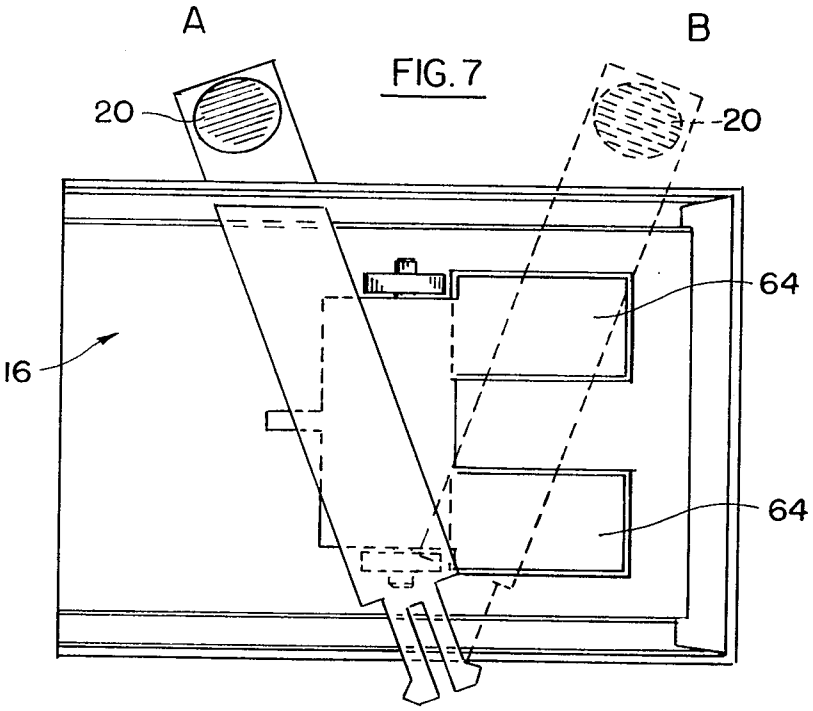
FIG. 7 is a bottom view of the ramp assembly.

The ramp assembly 16 is shown in FIGS. 6, 7, and 8. When the release lever 20 is in position A, a pivoted linkage member 60 is engaged by the lever and turned in a counter-clockwise direction so that a gate 62 protrudes up through the ramp to hold the vehicle on the ramp, and a trap door 64 is moved down to the position shown in FIG. 6. Actually, two trap doors 64 are provided, as seen in the bottom view of FIG. 7.

At the beginning of the race, the vehicle is moved along a surface by hand rapidly until its rear wheels spin at high speed. The vehicle is then set on the ramp with the spinning wheels extending into the open trap doors, and with the vehicle being held in place by the gate 62. Then, when the release lever 20 is moved to position B, as shown in FIG. 8, the trap doors 64 close, and gate 62 drops, releasing the vehicle.

Figures 9, 10, 11:
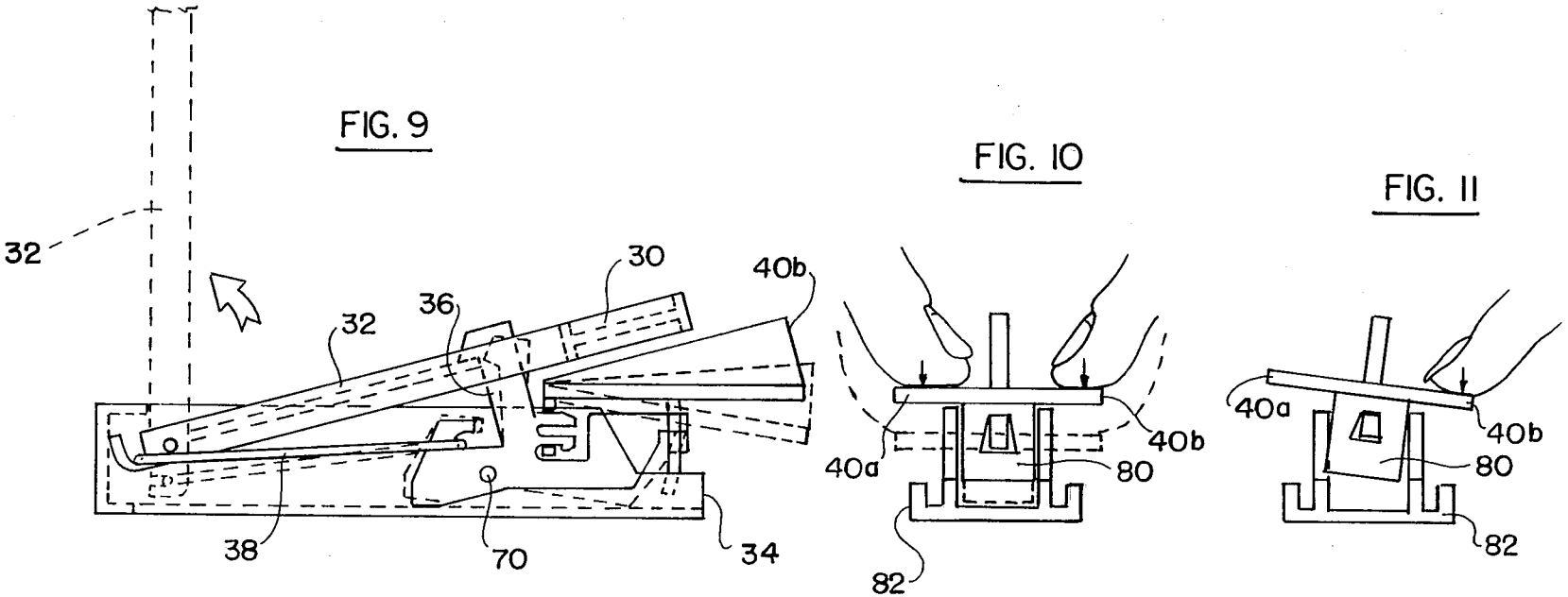
FIG. 9 is a side elevational view of the starting flag assembly of FIG. 4.
FIG. 10 is an elevational view of a duel controlled operating button included in the assembly of FIG. 9, showing the button in its upright position.
FIG. 11 is an elevational view of the button of FIG. 10 in its tilted inoperative position.

The starting flag assembly is shown in further detail in FIGS. 9, 10, and 11. The side elevational view of FIG. 9 showing the flag being held in its down position by latch 36 which is pivoted to base 34 by a pivot pin 70. The latch is coupled to the lower end of arm 32 by a the rubber band 38. Then, when the latch is released by pressing the push buttons 40A and 40B, the latch releases the arm 32, and it springs to its upright position.

As shown in FIGS. 10 and 11, the push buttons 40A and 40B are mounted on a common bracket 80 which, in turn, is pivotally mounted on a base 82. Only when both push buttons are depressed together, as shown in FIG. 10, is the the latch 36 actuated to release the flag. When one or the other of the push buttons 40A and 40B is operated alone, as shown in FIG. 11, the assembly merely tilts, and is not effective.

While a particular embodiment of the invention has been shown and described, modifications may be made. It is intended in the claims to cover all modifications which fall within the true spirit and scope of the invention.

We claim:

1. Racing game apparatus including: a track comprising a running surface and a pair of upright side members extending along the respective edges thereof; an inertia type motor vehicle to be propelled along the running surface of the track between the side members after its wheels are first set in a spinning condition; a ramp attached to one end of said track including a trap door for receiving the spinning wheels of the vehicle; a manually operated mechanism attached to said trap door for closing said trap door to release the vehicle from the ramp; a starting flag assembly attached to said ramp including a pivoted arm, a latch for holding the arm in an essentially horizontal position, resilient means coupled to the arm for biasing the arm to an upright position when released by the latch; and a manually operated release mechanism coupled to the latch, said release mechanism including a dual operated button assembly which responds only to the simultaneous operation by two persons to operate said release mechanism.

2. The racing game apparatus defined in claim 1, and which includes a gate mounted on said ramp for holding the vehicle; and linkage means coupling the release mechanism to the gate to cause the gate to open and release the vehicle when the trap door is closed.

3. The racing game apparatus defined in claim 1, and which includes a winner indicator gate assembly mounted at the end of the track remote from the ramp, said gate assembly including a rotatable upright post, and a barrier arm mounted on said post and extending horizontally across said track, said arm turning to an open position when struck by an vehicle.

4. The racing game apparatus defined in claim 1, and which includes a pair of said tracks, and a corresponding pair of said ramps respectively attached thereto, the respective tracks and ramps being positioned adjacent to one another; and in which said starting flag assembly is mounted between said ramps and includes a base attached to the respective ramps for holding the ramps and associated tracks in position adjacent to one another.

5. The racing game apparatus defined in claim 3, and which includes a pair of said tracks positioned adjacent to one another, and in which said winner indicator gate assembly is mounted between said tracks, and includes a base attached to the tracks for holding the tracks in position adjacent to one another.

6. Racing game apparatus including a starting flag assembly having a pivoted arm, latch for holding the arm in an essentially horizontal position, resilient means coupled to the arm for biasing the arm to an upright position when the arm is released from the latch; and a manually operated release mechanism coupled to the latch, said release mechanism including a pivotally mounted dual operated button assembly responding only to the simultaneous operation by two persons to actuate said release mechanism.

* * * * *